US008077071B2

(12) United States Patent
Cincotti et al.

(10) Patent No.: US 8,077,071 B2
(45) Date of Patent: Dec. 13, 2011

(54) ASSEMBLIES AND SYSTEMS FOR SIMULTANEOUS MULTISPECTRAL ADAPTIVE CAMOUFLAGE, CONCEALMENT, AND DECEPTION

(75) Inventors: K. Dominic Cincotti, Fayetteville, NC (US); Trevor J. Kracker, Lumberton, NC (US)

(73) Assignee: Military Wraps Research and Development, Inc., Lumberton, NC (US)

( * ) Notice: Subject to any disclaimer, the term of this patent is extended or adjusted under 35 U.S.C. 154(b) by 294 days.

(21) Appl. No.: 12/436,654

(22) Filed: May 6, 2009

(65) Prior Publication Data

US 2010/0288116 A1 Nov. 18, 2010

Related U.S. Application Data

(60) Provisional application No. 61/126,649, filed on May 6, 2008.

(51) Int. Cl.
*F41H 3/00* (2006.01)
*H01Q 17/00* (2006.01)

(52) U.S. Cl. ..... 342/3; 89/938

(58) Field of Classification Search ..... 342/3
See application file for complete search history.

(56) References Cited

U.S. PATENT DOCUMENTS

| | | | | |
|---|---|---|---|---|
| 2,292,848 | A | | 8/1942 | Robson |
| 4,034,375 | A | | 7/1977 | Wallin |
| 4,064,305 | A | | 12/1977 | Wallin |
| 4,156,033 | A | | 5/1979 | Bienz |
| 4,287,243 | A | | 9/1981 | Nielsen |
| 4,560,595 | A | * | 12/1985 | Johansson ..... 428/17 |
| 4,576,904 | A | | 3/1986 | Anitole |
| 4,767,649 | A | | 8/1988 | Birch |
| 5,013,375 | A | | 5/1991 | Leonard |
| 5,142,833 | A | | 9/1992 | Svehaug |
| 5,312,678 | A | | 5/1994 | McCullough, Jr. et al. |
| 5,348,789 | A | | 9/1994 | Hellwig |

(Continued)

FOREIGN PATENT DOCUMENTS

WO WO 2008/091242 7/2009

OTHER PUBLICATIONS

"How to Disappear," The Economist Technology Quarterly, Sep. 6, 2008, pp. 21 and 24.

(Continued)

*Primary Examiner* — Thomas Tarcza
*Assistant Examiner* — Matthew M Barker
(74) *Attorney, Agent, or Firm* — Jenkins, Wilson, Taylor & Hunt, P.A.

(57) ABSTRACT

Systems and assemblies for simultaneous adaptive camouflage, concealment and deception are provided. The assemblies that can be used in the systems include a vinyl substrate layer and a miniaturized thermoelectric device array secured to the vinyl substrate layer. The miniaturized thermoelectric device array is configured to provide an adaptive thermal signature to a side of the miniaturized thermoelectric device array that faces outward from the vinyl substrate layer. A flexible image display matrix can be secured on the vinyl substrate layer. The flexible image display matrix can be configured to display visual images. A laminate layer can be secured over the vinyl substrate layer covering the flexible image display matrix and the miniaturized thermoelectric device array to provide protection and strengthen the assemblies. One or more nanomaterials can be disposed on the vinyl substrate layer or the laminate layer to provide thermal or radar suppression.

41 Claims, 9 Drawing Sheets

U.S. PATENT DOCUMENTS

| | | | | |
|---|---|---|---|---|
| 5,381,149 | A | 1/1995 | Dougherty et al. | |
| 5,523,757 | A * | 6/1996 | Resnick | 342/1 |
| 5,734,495 | A | 3/1998 | Friedman | |
| 5,786,785 | A | 7/1998 | Gindrup et al. | |
| 5,892,476 | A | 4/1999 | Gindrup et al. | |
| 6,003,749 | A | 12/1999 | Sabo | |
| 6,127,007 | A | 10/2000 | Cox et al. | |
| 6,338,292 | B1 * | 1/2002 | Reynolds et al. | 89/36.02 |
| 6,692,030 | B1 | 2/2004 | Phillips et al. | |
| 6,712,058 | B2 | 3/2004 | Porter | |
| 6,805,957 | B1 | 10/2004 | Santos et al. | |
| 6,927,724 | B2 * | 8/2005 | Snaper | 342/3 |
| 7,148,161 | B2 | 12/2006 | Hellwig et al. | |
| 7,215,275 | B2 * | 5/2007 | Dumas | 342/3 |
| 7,345,616 | B2 * | 3/2008 | Williams | 342/4 |
| 7,511,653 | B2 | 3/2009 | Yu et al. | |
| 2004/0055068 | A1 | 3/2004 | Egnew | |
| 2005/0079330 | A1 | 4/2005 | Tanel | |
| 2005/0276955 | A1 | 12/2005 | Tooley | |
| 2006/0127570 | A1 | 6/2006 | Casburn et al. | |
| 2006/0222827 | A1 | 10/2006 | Marshall et al. | |
| 2007/0035435 | A1 | 2/2007 | Dumas | |
| 2009/0154777 | A1 | 6/2009 | Cincotti et al. | |
| 2009/0242597 | A1 | 10/2009 | Morgan et al. | |
| 2009/0252913 | A1 | 10/2009 | Cincotti et al. | |
| 2010/0012216 | A1 | 1/2010 | Salatino et al. | |
| 2010/0031423 | A1 | 2/2010 | Cincotti et al. | |
| 2010/0112316 | A1 | 5/2010 | Cincotti et al. | |
| 2010/0288116 | A1 | 11/2010 | Cincotti et al. | |

OTHER PUBLICATIONS

Press Release—"University Display Showcases Its Eco-Friendly, 'Green' PHOLED Technology at Ecofocus/New York," University Display Corporation, Apr. 29, 2009.

Navy Press Release No. 597-08, Jul. 15, 2008.

McKee et al., "Future Combat Vehicle Protected by an Active Camouflage System," Military Technology (Miltech), Jul. 17, 2009.

Lockheed Martin Press Release—"Lockheed Martin and Rice Corporation Partner on Nanotech Research," http://www.lockheed martin.com/cgi-bin/pfv.pl, Apr. 24, 2008.

KB Port Simulation Environments [online], Jan. 25, 2008 [retrieved on Jan. 28, 2009], www.kbport.com/products/pse-main.php?KeepThis=true&TB_iframe=true&width=805>; pp. 1-2; Figs. 1-2.

Kamouflage.net as of Aug. 16, 2010 found on website www.kamouflage.net/en_010400.php, copyright 2005 and 2008.

International Search Report and Written Opinion for PCT/US10/57455 dated Feb. 3, 2011.

International Search Report and Written Opinion for PCT/US09/39106 dated May 14, 2009.

International Preliminary Report on Patentability for PCT/US2009/039106 dated Oct. 14, 2010.

International Preliminary Report on Patentability for PCT/US2008/009374 dated Feb. 11, 2010.

Hooberman, B., "Everything You Ever Wanted to Know About Frequency-Selective Surface Filters but Were Afraid to Ask," http://calvin.phys.columbia.edu/group_web/filters/filter.pdf, May 2005.

Greenemeier, Larry: "Sticky Savior: U.S. Army Readies a New Blast-Protection Adhesive for Deployment," http://www.scientificamerica.com/article.cfm?id=army-polymer-adhesive, Dec. 18, 2008.

Gassler, John Jr.: "Military Wraps: The Next Generation in Combat Training Solutions," Special Operations Report, vol. 16, Sep. 15, 2008.

Florida, R., "Small Science with Big Promise—Nanotechnology Research at NJIT," NJIT Magazine, pp. 14-17, At least as early as Sep. 10, 2008.

Eom, Sang-Hyun, "White Phosporescent Organic Light-Emitting Devices with Dual Triple-Doped Emissive Layers," Appl. Phys. Lett., vol. 94, No. 15, 153303 (Apr. 16, 2009).

Eltron, "Advanced Nano-Phase Materials Promise to Revolutionize Solid State Power Generation, Peltier Heating/Cooling," Eltron Research and Development Tech Brief, 2009.

Depth Perception as of Oct. 24, 2007 found on the website http://en.wikipedia.org/wiki/Depth_perception.

Chwang, Anna B., "Thin Film Encapsulated Flexible Organic Electroluminescent Displays," Appl. Phys. Lett., vol. 83, 413, Jul. 21, 2003.

Cabot Corporation—"The Possibilities of Nanogel in Diverse Applications," http://www.cabot-corp.com/Aerogel/Coatings/What-Is-Aerogel/GN200811251355PM4239, at least as early as Nov. 25, 2008.

Bush, Steve—"Nextreme Patents Nano-Boost to Peltier Heat Pumps," Electronics Weekly.com, http://www.electronicsweekly.com/Articles/2008/04/01/43423/nextreme-patents-nano-boost-to-peltier-heat-pumps.htm, Mar. 24, 2008.

Boessenkool, A., "Lockheed Martin Looks to Nanotechnology," Lockheed Martin, Sep. 12, 2008.

Bellamkonda, R. et al., "Bismuth Telluride Nano-Coolers for Magnetic Sensors," 213th Electrochemical Society Meeting, May 18-23, 2108.

International Search Report and Written Opinion for PCT/US08/09374 dated Apr. 16, 2009.

* cited by examiner

ASSEMBLIES AND SYSTEMS FOR SIMULTANEOUS MULTISPECTRAL ADAPTIVE CAMOUFLAGE, CONCEALMENT, AND DECEPTION

RELATED APPLICATIONS

The presently disclosed subject matter claims the benefit of U.S. Provisional Patent Application Ser. No. 61/126,649, filed May 6, 2008; the disclosure of which is incorporated herein by reference in its entirety.

TECHNICAL FIELD

The present subject matter relates generally to the field of camouflage, concealment and deception for military purposes. More particularly, the present subject matter relates to systems and assemblies for simultaneous employment of adaptive camouflage, concealment, and deception and sensor counter-measure technologies that are incorporated into a lamina structure to inhibit detection of an intended physical item from optical or sensor system detection means.

BACKGROUND

Since World War II, tactical camouflage, concealment and deception designers have been forced to create solutions that addressed more than the visible spectrum of detection. This evolution is a result of increasingly sensitive sensor devices and technologies that have been developed over time. These sensor devices have included such divergent means as: enhanced optical range through advanced visual scopes, radar, night vision, and thermal imagery detection. Further, advances have led to technologies like forward looking infrared ("RJR") imaging technologies and shortwave infrared ("SWIR") sensing technologies that make invisible spectrum detection even better.

Today virtually every nation and many non-state military organizations have access to advanced tactical sensors for target acquisition (radar and thermal imagers) and intelligence gathering surveillance systems (ground and air reconnaissance). Precision-guided munitions exist that can be delivered by artillery, missiles, and aircraft and that can operate in the IR region of the electromagnetic spectrum. These capabilities are available through internal manufacturing or purchase on the world market. These advanced imaging sights and sensors allow enemies to acquire and engage targets through visual smoke, at night, and under adverse weather conditions.

Technologies and products are now merging these various sensor technologies together. There has been an increase in the fielding of devices that combine, merge or fuse two or more advanced sensor/image sources together. Sensor fusion is the combining of sensory data or data derived from sensory data from disparate sources such that the resulting information is in some sense better than would be possible when these sources were used individually. The term "better" in this case can mean more accurate, more complete, or more dependable, or refer to the result of an emerging view. As a result, the camouflage, concealment, and deception methods and products and sensor counter-measures that must be fielded today need to simultaneously decrease the efficacy of these processes both individually and universally.

To combat these new sensing and detection technologies, camouflage paint, paint additives, tarps, nets and foams have been developed for visual camouflage and thermal and radar signature suppression.

Paint and paint additives by themselves do not appear to be to provide a desired level of visual camouflage and thermal and radar signature suppression. For example, paint has proven inadequate for rendering highly detailed or complex camouflage patterns in use today, such as ACU and MARPAT, quickly and efficiently. Advanced paint additives and coatings seemed promising, but have unforeseen logistical issues. While it appears that chemical agent resistant coating ("CARC") paint is the ideal paint for camouflage and chemical protection, it is important to realize that it directly contributes to the problem. Several disadvantages are obvious when using CARC paint. CARC paint is considered environmentally hazardous, and its application requires Environmental Protection Agency ("EPA") approved safety equipment and facilities.

The EPA regulations restrict the use of CARC to one quart per site per day. Only approved facilities, such as depot-level maintenance facilities can dispense CARC in volume. This restriction on volume painting is attributed to the amount of volatile organic compounds released into the atmosphere when spraying. Further, CARC is expensive and has a limited shelf life. In fact, CARC is approximately four times more expensive than a low emission alkyd or polyurethane paint. Thus, from the bottle-necking that occurred in CARC paint facilities to EPA issues that make it problematic to repair without extensive costs to specialized equipment and facilities that are needed to the limited effectiveness against detection from the advanced technologies mentioned above, paints have proven to not be very effective.

Tarps and nets can provide separation between the vehicles being hidden and the point of observation of the detection systems used. Tarps and nets can suppress thermal signature as well as signals detected by radar. However, both tarps and nets can be heavy and cumbersome to use. They can thus interfere with mobility.

The use of foam appears to have promise regarding thermal and radar suppression. However, in the past, foam has been hard to effectively use in such camouflage, concealment or deception applications because the foam was not functional in terms of visual camouflage.

SUMMARY

It is an object of the presently disclosed subject matter to provide systems and assemblies whereby multispectral adaptive camouflage, concealment and detection counter-measure means and technologies can be incorporated into a single application and employed simultaneously for maximum tactical advantage. For example, a lamina structured assembly can be provided that is intended for the exterior of a physical item (manned and unmanned, land, sea, and air) to allow for multiple simultaneous forms of adaptive camouflage, concealment, deception and signature suppression in order to degrade the efficacy of both optical and advanced imaging or sensor fusion devices and the application of the same.

An object of the presently disclosed subject matter has been stated hereinabove, which is achieved in whole or in part by the presently disclosed subject matter.

Other objects will become evident as the description proceeds when taken in connection with the accompanying drawings as best described hereinbelow.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

DETAILED DESCRIPTION

Figure 1:
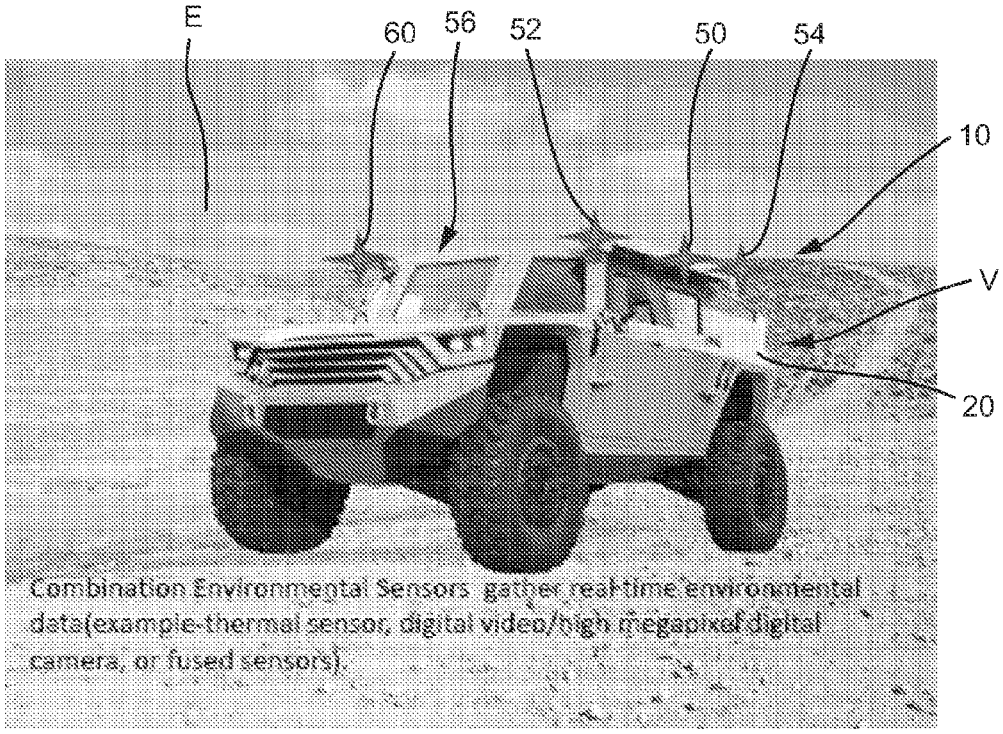
FIG. 1 illustrates a perspective view of a physical item that employs an embodiment of a system for simultaneous adaptive camouflage, concealment and deception according to the present subject matter.

Reference will now be made in detail to the description of the present subject matter, one or more examples of which are shown in the figures. Each example is provided to explain the subject matter and not as a limitation. In fact, features illustrated or described as part of one embodiment can be used in another embodiment to yield still a further embodiment. It is intended that the present subject matter cover such modifications and variations.

"Site-specific" as used herein means a specific local terrain, nautical position, or airspace where a physical item will be located or operating, or the environmental characteristics which would be found in the intended operating environment of the physical item.

"Image" as used herein means the optical counterpart of an object produced by an optical device, electromechanical device, or electronic device. As used herein, "image" can be used to refer to a whole image, for example, a photographic image as taken by a image capturing device, or a portion thereof.

"Image capturing device" as used herein means an optical device, electromechanical device, or electronic device that produces an optical counterpart of an object or environment in the form of an image. "Image capturing device" can include, but is not limited to cameras, digital cameras, video equipment, or the like.

"Physical item" as used herein can include, but is not limited to any and all types of vehicles (land, air and sea, and rail/manned & unmanned), aircraft, watercraft, structures, buildings, pipes and piping, equipment, weapons, hardware, and other items used for military or other purposes where camouflage can enhance its effective use or where the need for camouflage concealment or deception exists.

"Nanomaterial" as used herein means nano-scale technology, such as nanoparticles or clusters of nanoparticles. Nanoparticles behave as a whole unit in terms of its transport and properties. Nanomaterial can include but is not limited to aerogel in powder form, clusters of powdered aerogel, microspheres and clusters of microspheres.

The systems and related assemblies described herein provide multispectral adaptive camouflage, concealment and detection counter-measure means and technologies that can be incorporated into a single application and employed simultaneously to maximize tactical advantage. The system can include a lamina structured assembly that incorporates some of the detection counter measures available today. The lamina structured assembly can be produced and modified to include different detection counter measures as dictated, for example, by the type of mission in which the lamina structured assembly is to be used.

The lamina structured assembly can include multiple layers with one or more layer performing one or more functions to conceal the physical item to which it is attached. For example, the lamina structured assembly can include a vinyl substrate that serves as a carrier or substrate onto which other layers can be secured. The layers can include visual camouflage imagery and thermal, radar, and signal suppression. For example, the layers may include thin insulative layers, a frequency selective surface array to block or allow particular frequencies, a thin radar scattering layer, and exterior layer(s) that mimic and adapt to the environment visually and thermally.

The layers may incorporate, for example, radar and/or thermal suppression measures. Thermal and radar signature suppression counter-measures can be embedded into or between layers of this lamina structured assembly in the form of nanomaterials. These nanomaterials can include nano-scale, air or gas-filled microspheres or micro-balloons that can also be metallic coated, such as cenospheres, and pulverized nano-scale aerogels that consist of over 90% air in nano-scale pores that inhibit heat transfer with low density.

Aerogels that can be used in the camouflage system are solid-state materials with very low densities. Aerogels describe a class of material based upon their structure, namely low density, open cell structures, large surface areas (often 900 $m^2/g$ or higher) and sub-nanometer scale pore sizes. Supercritical and subcritical fluid extraction technologies are commonly used to extract the fluid from the fragile cells of the material. A variety of different aerogel compositions are known and may be inorganic or organic. Inorganic aerogels are generally based upon metal alkoxides and can include but are not limited to materials such as silica, carbides, and alumina. Organic aerogels include carbon aerogels and polymeric aerogels such as polyimides. Examples of appropriate Aerogels are available through Cabot Corp. located in Boston, Mass.

Aerogels can be derived from a gel in which the liquid component of the gel has been replaced with gas. The result is an extremely low-density solid with several remarkable properties, most notably its effectiveness as a thermal insulator. The Aerogels can be pulverized into a nano-scale powder. Aerogels, including powdered aerogels in nano-scale form, are good thermal insulators. As stated above, the aerogels can include silicon, carbon and metallic aerogels, such as alumina aerogels. Silica aerogels can be a good conductive insulator because silica is a poor conductor of heat. A metallic aerogel, on the other hand, may be a less effective insulator. Carbon aerogel is a good radiative insulator because carbon absorbs the infrared radiation that transfers heat at standard temperatures. Another good insulative aerogel is silica aerogel with carbon added to it.

When incorporated into a lamina structured assembly described herein and the camouflage system is secured around a physical item, such insulative aerogels can provide good suppression of the thermal signature of the physical item. The aerogels can be pulverized into a powder form and embedded into a layer of the lamina structured assembly such as the vinyl substrate layer during manufacturing of the layer. The aerogels can contain particles ranging in size between about 1 to 10 nm, for instance about 2 to about 5 nm, that are generally fused into clusters. Alternatively, the aerogels can be included in the adhesives, or laminate layer used in the lamina structured assembly. The inclusion of the aerogels, even in their pulverized or powder form, in the camouflage system can facilitate thermal suppression in the system and may improve radar suppression as well.

Similarly, microspheres can be included in the lamina structured assembly. Microspheres are hollow microsphere particles that can be made from metal (e.g., gold), metal oxides (e.g., $Al_2O_3$, $TiO_2$, $ZrO_2$), silica, or the like. Microspheres can be fabricated with various diameters and wall thicknesses. The microspheres can include glass microspheres and cenospheres. Hollow glass microspheres, sometimes termed microballoons, have diameters ranging from about 10 to about 300 micrometers. A cenosphere is a lightweight, inert, hollow sphere filled with inert air or gas, typically produced as a byproduct of coal combustion at thermal power plants. The color of cenospheres varies from gray to almost white and their density is about 0.4-0.8 g/cm$^3$, which gives them great buoyancy. Cenospheres are hard and rigid, light, waterproof, innoxious, and insulative. Such microspheres are available from CenoStar Corporation located in Newburyport, Mass.

When incorporated into a lamina structured assembly described herein and the camouflage system is secured around a physical item, microspheres such as those described above, including glass, ceramics, and/or alumina silicate, can provide good suppression of the radar signature of the physical item. These microspheres can be embedded into a layer such as the vinyl substrate layer during manufacturing of the layer. Alternatively, the microspheres can be included in the adhesives, or over-laminate used in the lamina structured assembly. The microspheres can contain particles ranging in size between about 10 to 300 micrometers, for example about 10 to about 20 micrometers. The microspheres can be generally fused into clusters. The microspheres separately and in clusters reflect waves in irregular or dispersed fashion to make a wave signature hard to detect. Thus, the inclusion of the microspheres in the camouflage system facilitates radar suppression and may improve thermal suppression in the system.

The lamina structured assembly can also include further layers that can provide thermal adaptability and suppression. A thin film thermal adaptor can be used. For example, miniaturized thermoelectric device arrays can be used to adjust the thermal signature of the physical item to which the lamina structured assembly is attached. The miniaturized thermoelectric device arrays can provide high cooling density and high power efficiency in a lightweight small form that are highly reliable. The miniaturized thermoelectric device arrays have fast cooling and heating times and provide excellent temperature control. Further, miniaturized thermoelectric device arrays operate silently and are environmentally friendly. Such arrays also provide versatility since they are orientation independent. The arrays are created from individual thermoelectric devices or modules. The thermoelectric devices can be operated in the arrays as a single entity. These miniaturized thermoelectric device arrays are available for example through Nextreme Thermal Solutions, Inc., located in Durham, N.C.

Such arrays can be electrically charged to create a Peltier effect through the device so that one side is cooled or heated. The miniaturized thermoelectric device arrays can comprise two different types of material, for example two different metals. The miniaturized thermoelectric device arrays can transfers heat from one side of the device to the other side against the temperature gradient (from cold to hot), with consumption of electrical energy. The miniaturized thermoelectric thin films can be simply connected to a DC voltage to cause one side to cool, while the other side warms. The effectiveness of the pump at moving the heat away from the cold side is dependent upon the amount of current provided and how well the heat from the hot side can be removed. In one example, nano-scale films of Bismuth Telluride ($Bi_2Te_3$) can be used in the miniaturized thermoelectric device array. Nanotubes of Bismuth Telluride ($Bi_2Te_3$) can be used to create p/n type alloy nanowires to generate the thermoelectric effect.

The lamina structured assembly can also include further layers that can provide radio waves suppression. For example, a frequency selective surface array that provides the user of the system or lamina structured assembly to filter frequencies. Such a filtering application can include the allowance of certain signals at a certain frequency range(s) to pass, while blocking other frequency range(s). Thus, for example, a cellular phone may be allowed to pass through the frequency selective surface array, while the frequency used by a wireless local area network may be block. The frequency selective surface array can be very thin. For example, the thickness can be on the order of between about 50 microns to about 100 microns. Different designs of frequency selective surface arrays can be used to block and permit different frequency ranges. Examples of frequency selective surface arrays are available through BAE Systems, PLC, located in London, England.

The frequency selective surface array can be incorporated into the lamina structured assembly, for example, by being embedded in the vinyl substrate layer or the laminate layer as will be described in greater detail below. The photolithography process used to produce the frequency selective surface array. A thin metal film is evaporated onto a substrate. Next, a film of photoresist is spread onto the substrate and placed in a mask aligner. In the mask aligner, UV light passes through a glass mask and strikes the substrate. The substrate is placed in developer, which removes the photoresist that has been exposed to UV. The substrate is then placed in a chemical bath which etches the metal film under the photoresist. Finally, the remaining photoresist is washed off with a stripper and cleaned the substrate with methanol and de-ionized water. Once created, the frequency selective surface array can be applied to vinyl substrate or other portion of the lamina structured assembly to permit and block select frequencies into and out of the physical item to which the lamina structured assembly is attached.

To provide visual camouflage, concealment and deception, a layer of a plurality of flexible image displays can be included in the lamina structured device. For example, the flexible image displays can include organic light emitting diode ("OLED") displays. These OLED displays can include polymer light emitting diode ("PLED") displays or phosphorescent OLED ("PHOLED") displays, such as electrophosphorescent OLED displays. Such OLED displays can be provided by Samsung SDI Ulju-gu located in Ulsan City, Korea.

OLED displays do not require a backlight to function. Thus, they draw far less power and, when powered from a battery, can operate longer on the same charge. Because there is no need for a backlight, an OLED display can be much thinner than an LCD panel. Further, the OLED displays can be flexible as the ones used in the lamina structured assembly. OLED can comprise single or multiple layers. A typical OLED is composed of an emissive layer, a conductive layer, a substrate, and anode and cathode terminals. The layers are made of organic molecules that conduct electricity. A voltage is applied across the OLED such that the anode is positive with respect to the cathode. This causes a current of electrons to flow through the device from cathode to anode which leads to a release of a radiation at a frequency within the visual region. OLEDs can be printed onto any suitable substrate using an inkjet printer or even screen printing technologies. Printing OLEDs onto flexible substrates permits their use in the lamina structured assemblies and systems described in more detail below.

Figure 2:
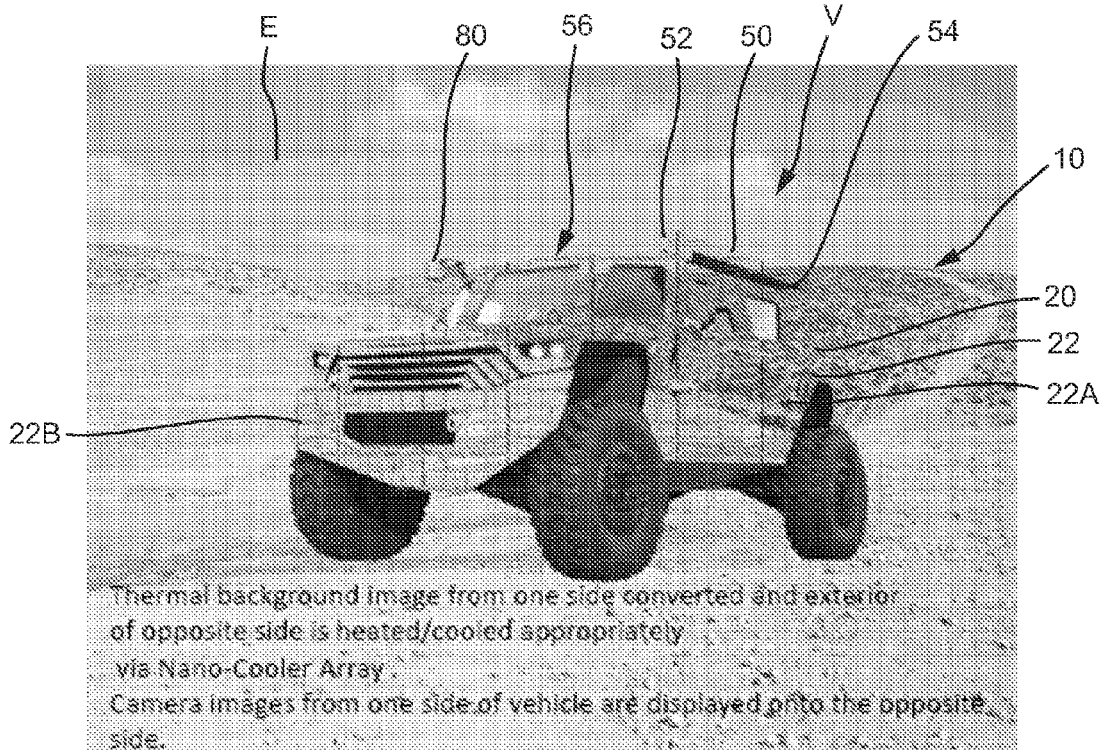
FIG. 2 illustrates a perspective view of the physical item that employs the system for simultaneous adaptive camouflage, concealment and deception according to FIG. 1.

FIGS. 1 and 2 illustrate a physical item, in the form of a vehicle, generally designated V, having a system 10 incorporates multispectral adaptive camouflage, concealment and detection counter-measure means and technologies to maximize the tactical advantage of the vehicle 10. The system 10 includes a lamina structured assembly 20 secured to the exterior of the vehicle V. The lamina structured assembly 20 includes multiple layers with one or more layer performing one or more functions to conceal the vehicle V. The layers can include visual camouflage and thermal, radar, and signal suppression. The layers may include thin insulative layers, a frequency selective surface array to block or allow particular frequencies, a thin radar scattering layer, and exterior layer(s) that mimic and adapt to the environment visually and thermally.

The system 10 can include a controller (not shown) on the vehicle V. The different layers of the lamina structured assembly 20 can be in communication with the controller. For example, a frequency selective surface array, or a flexible image display matrix, or a miniaturized thermoelectric device array that can be included in the lamina structured assembly 20 can be in communication with the controller. The controller can control the output of each of these layers and can dictate when each is activated. For example, the controller can dictate when the frequency selective surface array is activated. The controller can determine and control the images displayed on the flexible image display matrix. Further, the controller can manage the temperature that the miniaturized thermoelectric device array exhibits outward from the lamina structured assembly 10.

The system 10 can also include at least one image capturing device 50. For example, multiple image capturing devices 50, 52, 54 can be used to capture images of the environment surrounding the vehicle V with lamina structured assembly secured thereto. Alternatively, an image capturing device can be used. The image capturing devices 50, 52, 54 can be a digital camera that can take images or video. The image capturing devices 50, 52, 54 can be positioned on the four sides of vehicle V to capture images on all sides of the vehicle V.

The system 10 can also include at least one sensor 60 that can be used to collect environmental data from around the environment E surrounding the vehicle V. For example, the sensor 60 can collect thermal information such as the surrounding temperature.

The at least one image capturing device 50, 52, 54 and the at least one sensor 60 can also be in communication with the controller to provide information to the controller. For example, the controller can use the environment data from the at least one sensor 60 and the captured imaged from the image capturing devices to determine and control the output of the various layers of the lamina structured assembly with which it is in communications.

For example, as shown in FIG. 2, the images provided to the controller (not shown) can be displayed on a flexible image display matrix 22 of the lamina structured assembly 20. The flexible image display matrix 22 can comprise individual flexible image displays 22A, 22B that work in unison to display a piece of a larger image or images as directed by the controller. Further, thermal camouflage in the form of the lamina structured assembly 20 exhibiting an outward temperature closer to the temperature of the surrounding environment than the inner temperature of the vehicle V can be accomplished through miniature thermoelectric device arrays (not shown) contained in the lamina structured assembly 20 that are controlled by the controller. The outward temperature of the lamina structured assembly that is attached vehicle is calculated by the controller and the controller directs the miniature thermoelectric device arrays to heat or cool appropriately to mimic the temperature of the surrounding environment.

Figure 3:
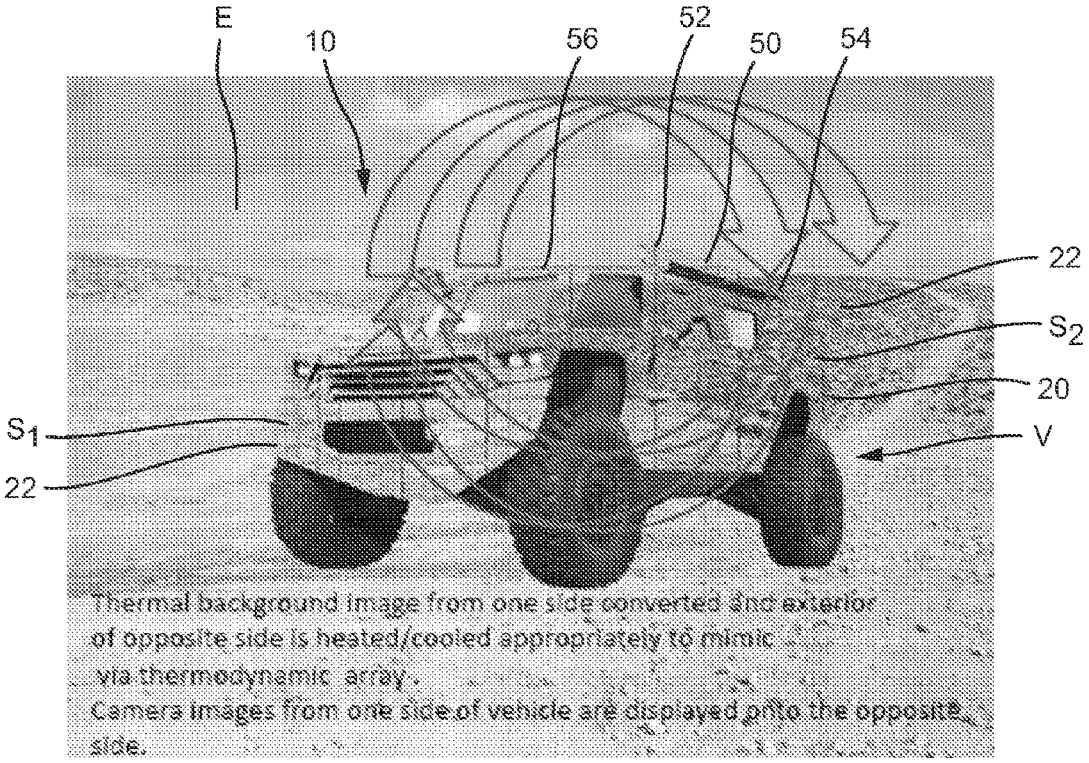
FIG. 3 illustrates a perspective view of the physical item that employs the system for simultaneous adaptive camouflage, concealment and deception according to FIG. 1.
Figure 4:
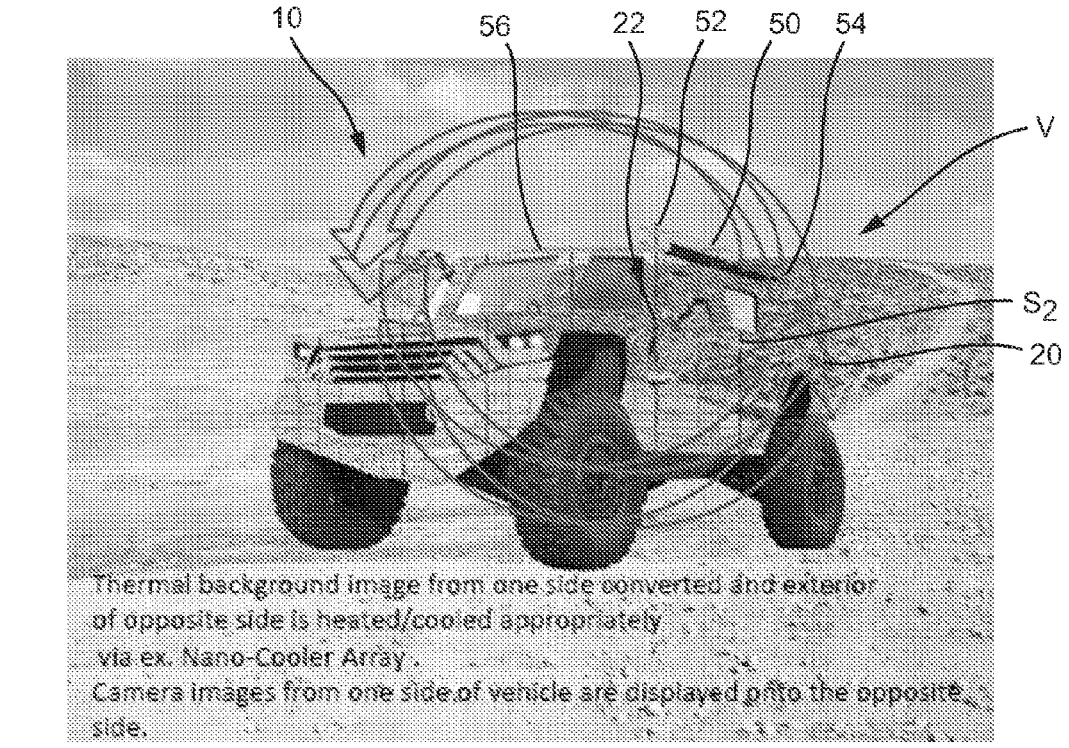
FIG. 4 illustrates a perspective view of the physical item that employs the system for simultaneous adaptive camouflage, concealment and deception according to FIG. 1.

As shown in FIGS. 3 and 4, the system 10 can display the images captured on one side of the vehicle V on the opposite side. For example, as shown in FIG. 3, the image(s) taken by the image capturing device 54 of the environment behind the vehicle V is displayed on the display matrix 22 of the lamina structured assembly 20 on the front side $S_1$ of the vehicle V from a predetermined perspective point. Similarly, the image(s) taken by the image capturing device 52 of the environment in front of the vehicle V is displayed on the display matrix 22 of the lamina structured assembly 20 on the back side (not shown) of the vehicle V from a predetermined perspective point.

As shown in FIG. 4, the image(s) taken by the image capturing device 56 of the environment behind the vehicle V is displayed on the display matrix 22 of the lamina structured assembly 20 on the side $S_2$ of the vehicle V from a predetermined perspective point. Similarly, the image(s) taken by the image capturing device 50 of the environment in front of the vehicle V is displayed on the display matrix 22 of the lamina structured assembly 20 on the side (not shown) opposite the side $S_2$ of the vehicle V from a predetermined perspective point.

Figure 5:
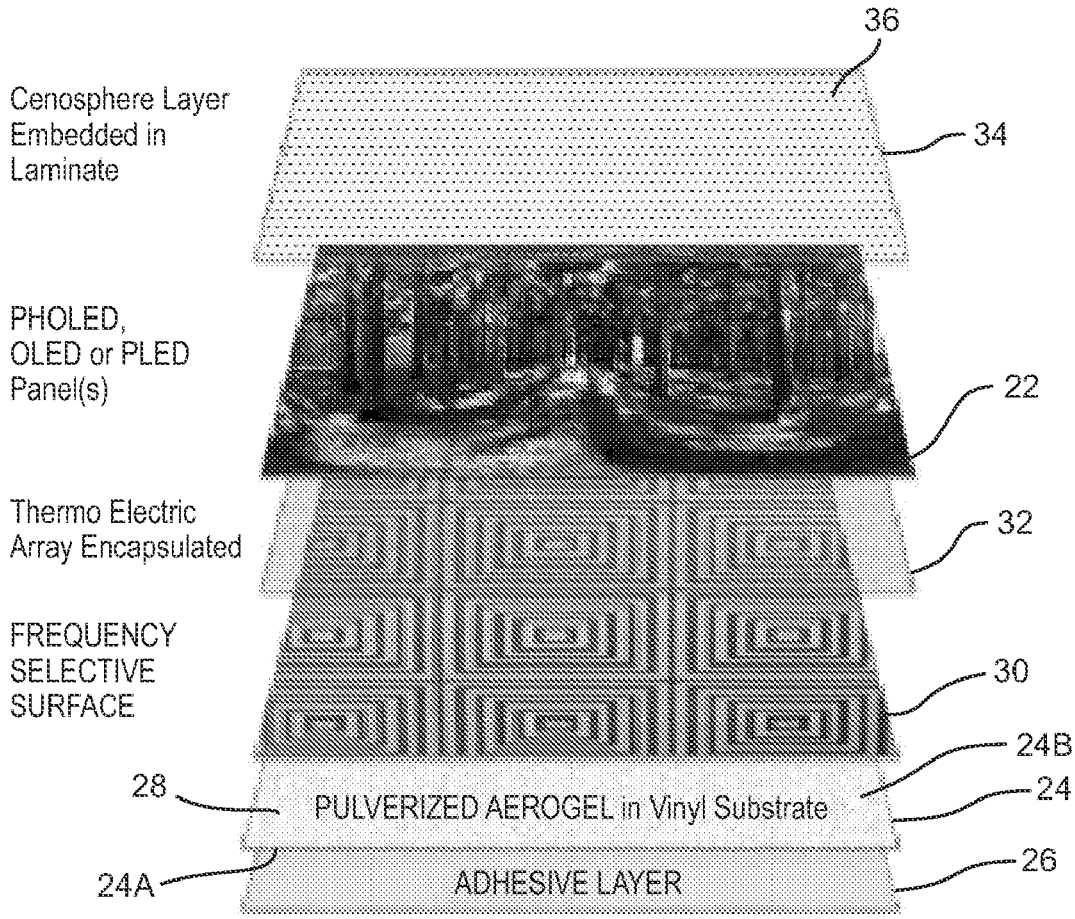
FIG. 5 illustrates a schematic view of an embodiment of a lamina structured assembly according to the present subject matter.

FIG. 5 illustrates a lamina structured assembly 20 that can be used in the system 10 as described above that can provide multispectral adaptive camouflage, concealment and deception to a physical item to which it is attached. The lamina structured assembly 20 can include a vinyl substrate layer 24 that acts as a carrier for the lamina structured assembly 20. An example of a vinyl substrate layer that can be used is a polyvinyl chloride ("PVC") film. The vinyl substrate layer 24 can have a thickness of between about 0.3 mm and about 1.5 mm. The vinyl substrate 24 can have an adhesive layer 26 attached to a bottom surface 24A. The adhesive layer 26 can be used to secure the lamina structured assembly 20 to the physical item to be covered. The adhesive layer 26 can be a permanent, opaque, acrylic, pressure sensitive adhesive with air egress technology. A 80# polycoated liner can be supplied and be used to cover the adhesive layer 26. The liner can be used as a release liner to protect the adhesive until time for application. Below is a list of physical properties of an example acrylic adhesive that can be applied to a substrate such as the PVC film described above.

TABLE 1

Properties of an Example Pressure Adhesive

| Physical Properties | Typical Values | Test Method (Federal Test Methods used) |
|---|---|---|
| Peel Adhesion, lb./in. (N/25 mm) 180 degrees on glass - 24 hr | about 3.2-about 4.6 (about 14-20) | FTM - 1 |
| Quick Tack on Glass lb./in. (N/25 mm) | about 3.4-about 4.8 (about 15-about 21) | FTM - 9 |
| Dimensional Stability, (%) 10" by 10" sample bonded to Aluminum | Maximum of about 0.5 | FTM - 14 |
| Normal Application Temperature and Temperature Ranges for Minimum Application | Above about 50° F. (about +10° C.) About −40° F. to about 194° F. (about −40° C. to about 90° C.) | |

A first nanomaterial 28 can be disposed on the vinyl substrate layer 24. The first nanomaterial 28 can provide thermal suppression to the physical item to which the lamina structured assembly 20 is applied. For example, the nanomaterial 28 can comprise an aerogel as described in detail above. The nanomaterial 28 can be added to the vinyl substrate layer 24 by a sputtering to randomly yet precisely dispose the nanomaterial 28 on the substrate layer 24. Alternatively, the nanomaterial 28 can be added to and mixed in with the material out of which the vinyl substrate layer 24 is made before the formation of the vinyl substrate layer 24. The vinyl substrate layer 24 can be thin. For example, the vinyl substrate layer 24 have a thickness of between about 0.3 mm and about 1.5 mm, for instance, 1.0 mm.

A frequency selective surface array 30 as described above can be secured to the vinyl substrate layer. For example, the frequency selective surface array can be embedded in the vinyl substrate layer 24. The frequency selective surface array can be configurable to permit transmission of signals within one or more selected frequency ranges and to block transmission of signals within one or more other selected frequency ranges. A controller (not shown) can activate the frequency selective surface array 30. In some embodiments, the frequency selective surface arrays can be tuneable. Thereby, the ranges of frequencies that are permitted to pass and the ranges of frequencies blocked can be changed.

A miniaturized thermoelectric device array 32 as described above can be secured to the vinyl substrate layer 24 overtop of the frequency selective surface array 30. The miniaturized thermoelectric device array 32 can be configured to provide an adaptive thermal signature to a side 32A of the miniaturized thermoelectric device array 32 that faces outward from the vinyl substrate layer 24. The adaptive thermal signature, i.e., the temperature, to be mimicked can be supplied to the controller (not shown) by a sensor. The controller can direct the miniaturized thermoelectric device array 32 to mimic the desired temperature. These arrays can be thin. For example, the displays have a thickness of between about 1.5 mm when include in the vinyl substrate layer 24.

A flexible image display matrix 22 can also secured on the vinyl substrate layer 24 overtop of the miniaturized thermoelectric device array 32. As stated above, the flexible image display matrix 22 is configured to display visual images. The flexible image display matrix 22 can comprise a plurality of flexible image displays, such as OLED displays, PLED displays, or PHOLED displays. These displays can be thin. For example, the displays have a thickness of between about 0.4 mm and about 0.7 mm. In this manner, the flexible image display matrix 22 can provide visual camouflage. For example, the controller (not shown) can direct the flexible image display matrix 22 to display an image taken by an imaging capturing device in the environment in which the physical item to which the lamina structured assembly 20 is applied operates.

A laminate layer 34 secured over the front surface 24B of the vinyl substrate layer 24 coating the flexible image display matrix 22 to provide protection to the a flexible image display matrix 22 and strengthen the lamina structured assembly.

A second nanomaterial 36 can be disposed on the laminate layer 34. The second nanomaterial 36 can provide radar suppression to the physical item to which the lamina structured assembly 20 is applied. For example, the A second nanomaterial 36 can comprise microspheres as described in detail above. The second nanomaterial 36 can be added to the vinyl substrate layer 24 by a sputtering to randomly yet precisely dispose the second nanomaterial 36 on the substrate layer 24. Alternatively, the second nanomaterial 36 can be added to and mixed in with the material out of which the laminate layer 34 is made before the formation of the laminate layer 34.

Laminating lamina structured assembly 20 can add strength and protection to the layers of the lamina structured assembly 20. For example, a laminate layer when bonded can provide protection to a physical item on which it is applied (and any individuals inside) against chemical and biological agents and it can help protect the physical item and the multiple layers therein from corrosive agents as well. It can also be used to add gloss or a reflection control layer. In particular, the laminate layer can add non-shiny protection by being non-gloss or low gloss in nature.

The laminate layer used in such a lamination process can be a highly conformable cast film, such as a PVC film. Alternatively, it can be a polyester (PET) film that can range in thickness from about 0.5 mm to about 10 mm. For example, highly conformable cast film having thickness of about 1.0 mm can be used. A cast vinyl or PET laminate layer can have a built-in ultraviolet protection, be optically clear, and have a low gloss or no-gloss (flat) finish or matte. The laminate can include a permanent adhesive, such as an acrylic adhesive.

The layers of the lamina structured assembly and the laminate layer can be run through a lamination process where the adhesive side of the laminate faces the printed side of the substrate. The laminate layer and the other layers can then pass through pressurized heated or unheated rollers to secure the laminate layer to the other layers. The laminate layer can be usable in temperatures from about 50° F. to about 225° F. Thus, the laminate layer can be applied to the other layers in hot and cold applications In another example, a 1.5-mil clear matte or a 1.5-mil clear gloss, which are highly conformable cast PVC films, can be chosen as the laminate layer. The over-laminate film is coated on one side with a clear permanent, acrylic pressure sensitive adhesive and supplied with a 1.2 mil polyester release liner. Upon application, the release liner can be removed. The vinyl layer with the camouflage pattern printed thereon and the laminate layer can be aligned so that the adhesive side of the laminate layer faces the printed side of the vinyl layer. The laminate layer and vinyl layer can then pass through pressurized rollers to secure the laminate layer to the vinyl layer. UV protection can incorporated into the laminate layer to help extend the life of the graphic by resisting color fade caused by ultraviolet light.

Suitable layers with the printed patterns described above that have a protective overcoating laminated thereto can provide excellent substrates to incorporate nanomaterials that can provide radar and/or thermal suppression as well. As mentioned above, nanomaterials such as appropriate aerogels and microspheres can be incorporated into different layer in different manners and at different stages described above. For example, each nanomaterial can be added to the laminate layers and vinyl layer on which the camouflage pattern is printed by a sputtering to randomly yet precisely dispose the nanomaterial on the respective layer. Alternatively, the nanomaterial(s) can be added to and mixed in with the material out of which the respective layers are made before the formation of the respective layers. Similarly, the nanomaterials can be added to the ink used to print the camouflage pattern on the vinyl layer or to the adhesive used in the adhesive layer by mixing the nanomaterials into either the ink or the adhesive before application on the vinyl layer. The amount of nanomaterial added to the camouflage system can vary. Also, the amount of nanomaterial added to the camouflage system can be customized to the application in which the camouflage system will be used or to the signature detection technology anticipated in the area of operation.

Figure 6:
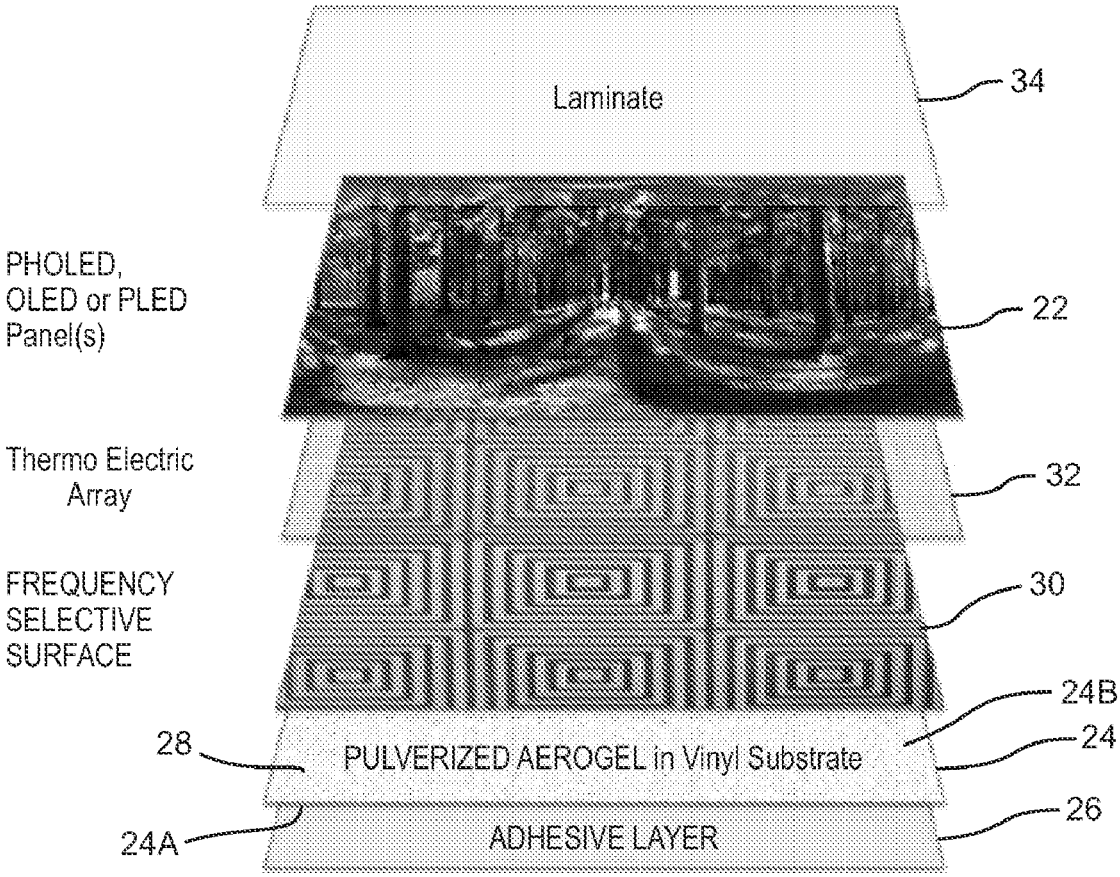
FIG. 6 illustrates a schematic view of another embodiment of a lamina structured assembly according to the present subject matter.

FIG. 6 illustrates a similar lamina structure as the one depicted in FIG. 5. FIG. 6 illustrates a lamina structured assembly 20 that can be used in the system 10 as described above. The lamina assembly 20 in FIG. 6 is the same as the lamina structured assembly in FIG. 5, except no second nanomaterial that provides a radar suppression layer is disposed on the laminate layer 34. The lamina structured assembly 20 shown in FIG. 6 only includes a first nanomaterial 28, for example, a powdered aerogel. In other embodiments, the lamina structured assembly can only include a second nanomaterial, such as microspheres, to facilitate radar suppression.

Figure 7:
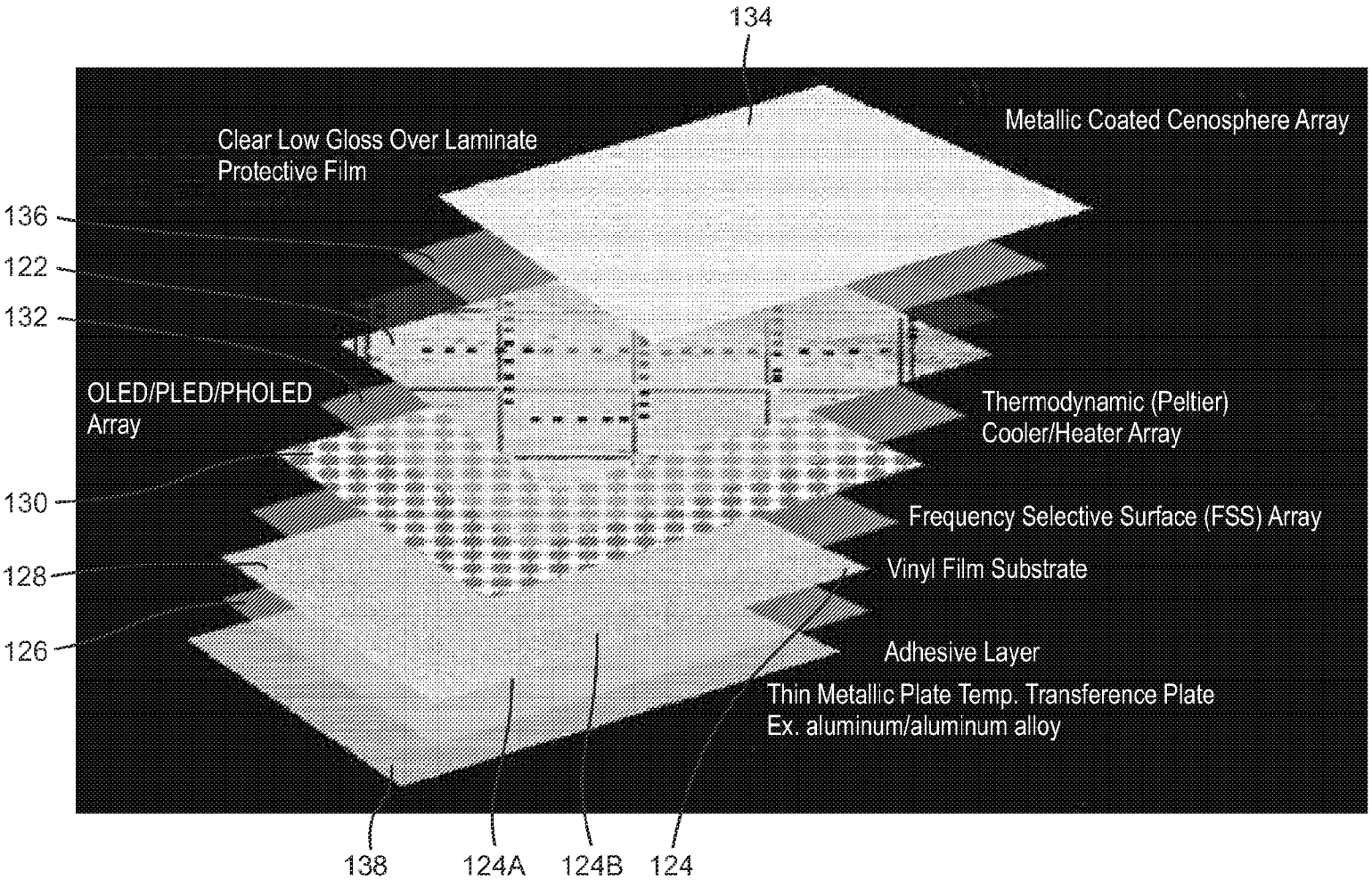
FIG. 7 illustrates a schematic view of a further embodiment of a lamina structured assembly according to the present subject matter.

FIG. 7 illustrates a similar lamina structure as the one depicted in FIG. 5. FIG. 7 illustrates a lamina structured assembly 120 that can be used in the system 10 as described above that can provide multispectral adaptive camouflage, concealment and deception to a physical item to which it is attached. The lamina structured assembly 120 can include a vinyl substrate layer 124 that acts as a carrier for the lamina structured assembly 120. An example of a vinyl substrate layer that can be used is a polyvinyl chloride ("PVC") film. The vinyl substrate layer 124 can have a thickness of between about 0.3 mm and about 1.5 mm. The vinyl substrate 124 can have an adhesive layer 126 attached to a bottom surface 124A.

A first nanomaterial 128 can be disposed on the vinyl substrate layer 124 to provide a thermal suppression layer. The first nanomaterial 128 can provide thermal suppression to the physical item to which the lamina structured assembly 120 is applied. For example, the nanomaterial 128 can comprise an aerogel as described in detail above. The nanomaterial 128 can be added to the vinyl substrate layer 124 by a sputtering to randomly yet precisely dispose the nanomaterial 128 on the substrate layer 124. Alternatively, the nanomaterial 128 can be added to and mixed in with the material out of which the vinyl substrate layer 124 is made before the formation of the vinyl substrate layer 124.

A frequency selective surface array 130 as described above can be secured to the vinyl substrate layer. For example, the frequency selective surface array can be embedded in the vinyl substrate layer 124. The frequency selective surface array can be configurable to permit transmission of signals within one or more selected frequency ranges and to block transmission of signals within one or more other selected frequency ranges. A controller (not shown) can activate the frequency selective surface array 130.

A miniaturized thermoelectric device array 132 as described above can be secured to the vinyl substrate layer 124 overtop of the frequency selective surface array 130. The miniaturized thermoelectric device array 132 can be configured to provide an adaptive thermal signature to a side 132A of the miniaturized thermoelectric device array 132 that faces outward from the vinyl substrate layer 124. The adaptive thermal signature, i.e., the temperature, to be mimicked can be supplied to the controller (not shown) by a sensor. The controller can direct the miniaturized thermoelectric device array 132 to mimic the desired temperature.

A flexible image display matrix 122 can also secured on the vinyl substrate layer 124 overtop of the miniaturized thermoelectric device array 132. As stated above, the flexible image display matrix 122 is configured to display visual images. The flexible image display matrix 122 can comprise a plurality of flexible image displays, such as OLED displays, PLED displays, or PHOLED displays. In this manner, the flexible image display matrix 122 can provide visual camouflage. For example, the controller (not shown) can direct the flexible image display matrix 122 to display an image taken by an imaging capturing device in the environment in which the physical item to which the lamina structured assembly 120 is applied operates.

A laminate layer 134 secured over the front surface 124B of the vinyl substrate layer 24 coating the flexible image display matrix 122 to provide protection to the a flexible image display matrix 122 and strengthen the lamina structured assembly.

A second nanomaterial 136 can be disposed on the laminate layer 134 to provide a radar suppression layer. The second nanomaterial 136 can provide radar suppression to the physical item to which the lamina structured assembly 120 is applied. For example, the second nanomaterial 136 can comprise microspheres as described in detail above. The second nanomaterial 136 can be added to the vinyl substrate layer 124 by a sputtering to randomly yet precisely dispose the second nanomaterial 136 on the substrate layer 124. Alternatively, the second nanomaterial 136 can be added to and mixed in with the material out of which the laminate layer 134 is made before the formation of the laminate layer 134.

The layers of the lamina structured assembly 120 can be connected to a thin metallic plate 138. For example, the metallic plate 138 can comprise aluminum or aluminum alloy. The side of the adhesive layer 124 opposite the vinyl substrate layer 124 can securely contact the metallic plate 138 to secure the vinyl substrate layer to the metallic plate 138. The metallic plate 138 adds a level of rigidity to the lamina structured assembly 120. The lamina structured assembly 120 with the metallic plate 138 can be secured to the physical item it is to cover by a mechanical means such as screws or nuts and bolts.

Figure 8:
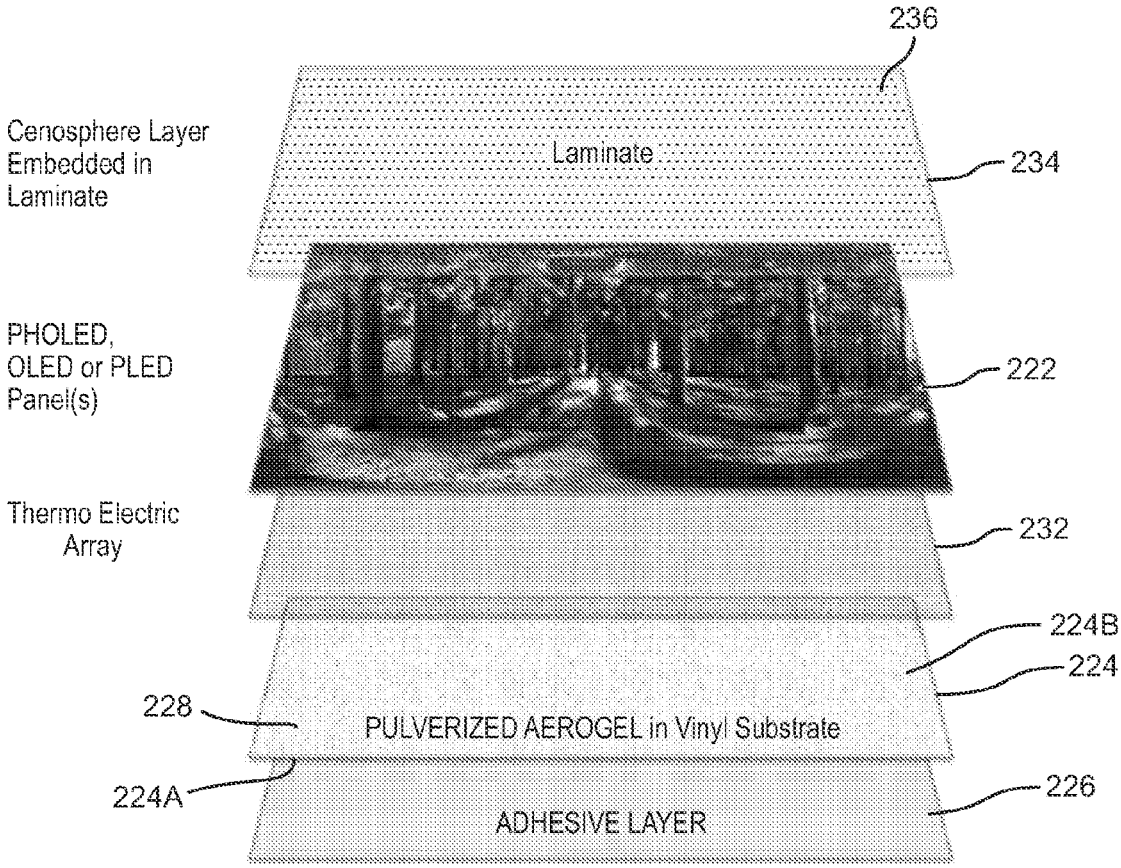
FIG. 8 illustrates a schematic view of an embodiment of a lamina structured assembly according to the present subject matter.

FIG. 8 illustrates another embodiment of a lamina structured assembly. FIG. 8 illustrates a lamina structured assembly 220 that can be used in the system 10 as described above that can provide multispectral adaptive camouflage, concealment and deception to a physical item to which it is attached. The lamina structured assembly 220 can include a vinyl substrate layer 224 that acts as a carrier for the lamina structured assembly 220. An example of a vinyl substrate layer that can be used is a polyvinyl chloride ("PVC") film. The vinyl substrate 224 can have an adhesive layer 226 attached to a bottom surface 224A. The adhesive layer 226 can be used to secure the lamina structured assembly 220 to the physical item to be covered.

A first nanomaterial 228 can be disposed on the vinyl substrate layer 224. The first nanomaterial 228 can provide thermal suppression to the physical item to which the lamina structured assembly 220 is applied. For example, the nanomaterial 228 can comprise an aerogel as described in detail above. The nanomaterial 228 can be added to the vinyl substrate layer 224 by a sputtering to randomly yet precisely dispose the nanomaterial 228 on the substrate layer 224. Alternatively, the nanomaterial 228 can be added to and mixed in with the material out of which the vinyl substrate layer 224 is made before the formation of the vinyl substrate layer 224.

A miniaturized thermoelectric device array 232 as described above can be secured to the vinyl substrate layer 224 overtop of the frequency selective surface array 230. The miniaturized thermoelectric device array 232 can be configured to provide an adaptive thermal signature to a side 232A of the miniaturized thermoelectric device array 232 that faces outward from the vinyl substrate layer 224. The adaptive thermal signature, i.e., the temperature, to be mimicked can be supplied to the controller (not shown) by a sensor. The controller can direct the miniaturized thermoelectric device array 232 to mimic the desired temperature.

A flexible image display matrix 222 can also secured on the vinyl substrate layer 224 overtop of the miniaturized thermoelectric device array 232. As stated above, the flexible image display matrix 222 is configured to display visual images. The flexible image display matrix 222 can comprise a plurality of flexible image displays, such as OLED displays, PLED displays, or PHOLED displays. In this manner, the flexible image display matrix 222 can provide visual camouflage. For example, the controller (not shown) can direct the flexible image display matrix 222 to display an image taken by an imaging capturing device in the environment in which the physical item to which the lamina structured assembly 220 is applied operates.

A laminate layer 234 secured over the front surface 224B of the vinyl substrate layer 224 coating the flexible image display matrix 222 to provide protection to the a flexible image display matrix 222 and strengthen the lamina structured assembly.

A second nanomaterial 236 can be disposed on the laminate layer 234. The second nanomaterial 236 can provide radar suppression to the physical item to which the lamina structured assembly 220 is applied. For example, the second nanomaterial 236 can comprise microspheres as described in detail above. The second nanomaterial 236 can be added to the vinyl substrate layer 224 by a sputtering to randomly yet precisely dispose the second nanomaterial 236 on the substrate layer 224. Alternatively, the second nanomaterial 236 can be added to and mixed in with the material out of which the laminate layer 234 is made before the formation of the laminate layer 234.

Figure 9:
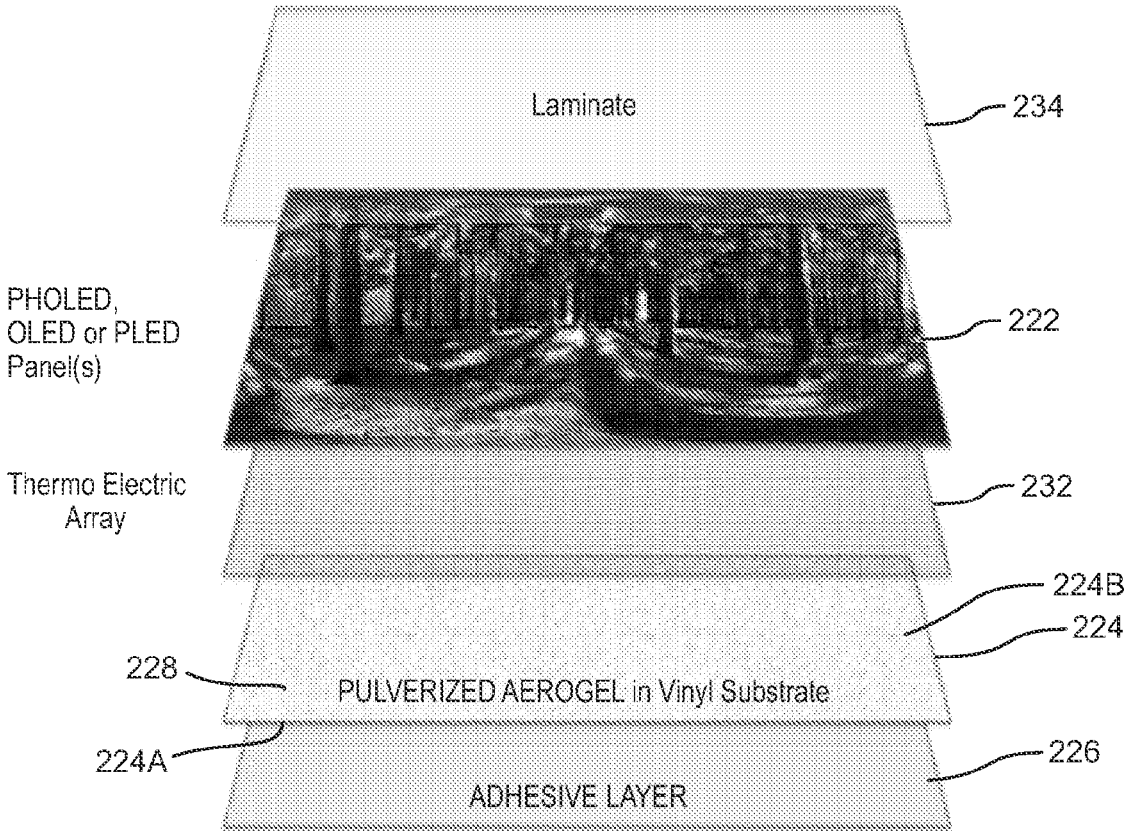
FIG. 9 illustrates a schematic view of another embodiment of a lamina structured assembly according to the present subject matter.

FIG. 9 illustrates a similar lamina structure as the one depicted in FIG. 8. FIG. 9 illustrates a lamina structured assembly 220 that can be used in the system 10 as described above. The lamina assembly 220 in FIG. 9 is the same as the lamina structured assembly in FIG. 8, except no second nanomaterial is disposed on the laminate layer 234. The lamina structured assembly 220 shown in FIG. 9 only includes a first nanomaterial 228, for example, a powdered aerogel. In other embodiments, the lamina structured assembly may only include a second nanomaterial, such as microspheres, to facilitate radar suppression.

Figure 10:
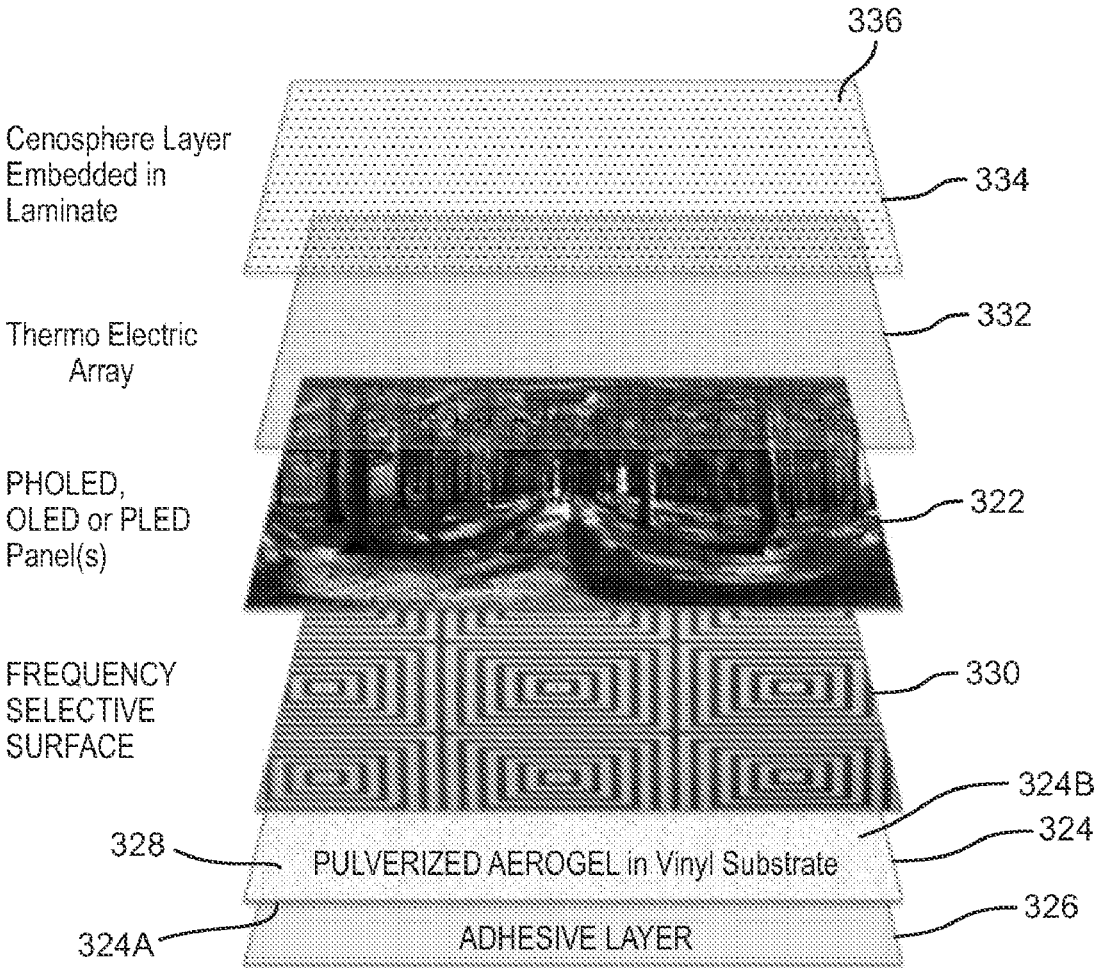
FIG. 10 illustrate a schematic view of a further embodiment of a lamina structured assembly according to the present subject matter.

FIG. 10 illustrates a similar lamina structure as the one depicted in FIG. 5. FIG. 10 illustrates a lamina structured assembly 320 that can be used in the system 10 as described above that can provide multispectral adaptive camouflage, concealment and deception to a physical item to which it is attached. The lamina structured assembly 320 can include a vinyl substrate layer 324 that acts as a carrier for the lamina structured assembly 320. An example of a vinyl substrate layer that can be used is a polyvinyl chloride ("PVC") film. The vinyl substrate layer 324 can have a thickness of between about 0.3 mm and about 1.5 mm. The vinyl substrate 324 can have an adhesive layer 326 attached to a bottom surface 324A.

A first nanomaterial 328 can be disposed on the vinyl substrate layer 324 to provide a thermal suppression layer. The first nanomaterial 328 can provide thermal suppression to the physical item to which the lamina structured assembly 320 is applied. For example, the nanomaterial 328 can comprise an aerogel as described in detail above. The nanomaterial 328 can be added to the vinyl substrate layer 324 by a sputtering to randomly yet precisely dispose the nanomaterial 328 on the substrate layer 324. Alternatively, the nanomaterial 328 can be added to and mixed in with the material out of which the vinyl substrate layer 324 is made before the formation of the vinyl substrate layer 324.

A frequency selective surface array 330 as described above can be secured to the vinyl substrate layer. For example, the frequency selective surface array can be embedded in the vinyl substrate layer 324. The frequency selective surface array can be configurable to permit transmission of signals within one or more selected frequency ranges and to block transmission of signals within one or more other selected frequency ranges. A controller (not shown) can activate the frequency selective surface array 330.

A flexible image display matrix 322 can also secured on the vinyl substrate layer 324 overtop of the frequency selective surface array 330. As stated above, the flexible image display matrix 322 is configured to display visual images. The flexible image display matrix 322 can comprise a plurality of flexible image displays, such as OLED displays, PLED displays, or PHOLED displays. These displays can be thin. For example, the displays have a thickness of between about 0.4 mm and about 0.7 mm. In this manner, the flexible image display matrix 322 can provide visual camouflage. For example, the controller (not shown) can direct the flexible image display matrix 322 to display an image taken by an imaging capturing device in the environment in which the physical item to which the lamina structured assembly 320 is applied operates.

A miniaturized thermoelectric device array 332 as described above can be secured to the vinyl substrate layer 324 overtop of the miniaturized thermoelectric device array 332. The miniaturized thermoelectric device array 332 can be configured to provide an adaptive thermal signature to a side 332A of the miniaturized thermoelectric device array 332 that faces outward from the vinyl substrate layer 324. The adaptive thermal signature, i.e., the temperature, to be mimicked can be supplied to the controller (not shown) by a sensor. The controller can direct the miniaturized thermoelectric device array 332 to mimic the desired temperature.

A laminate layer 334 secured over the front surface 324B of the vinyl substrate layer 324 miniaturized thermoelectric device array 332 to provide protection to the a flexible image display matrix 322 and strengthen the lamina structured assembly.

A second nanomaterial 336 can be disposed on the laminate layer 334 to create a radar suppression layer. The second nanomaterial 336 can provide radar suppression to the physical item to which the lamina structured assembly 320 is applied. For example, the second nanomaterial 336 can comprise microspheres as described in detail above. The second nanomaterial 336 can be added to the vinyl substrate layer 324 by a sputtering to randomly yet precisely dispose the second nanomaterial 336 on the substrate layer 324. Alternatively, the second nanomaterial 336 can be added to and mixed in with the material out of which the laminate layer 334 is made before the formation of the laminate layer 334.

Figure 11:
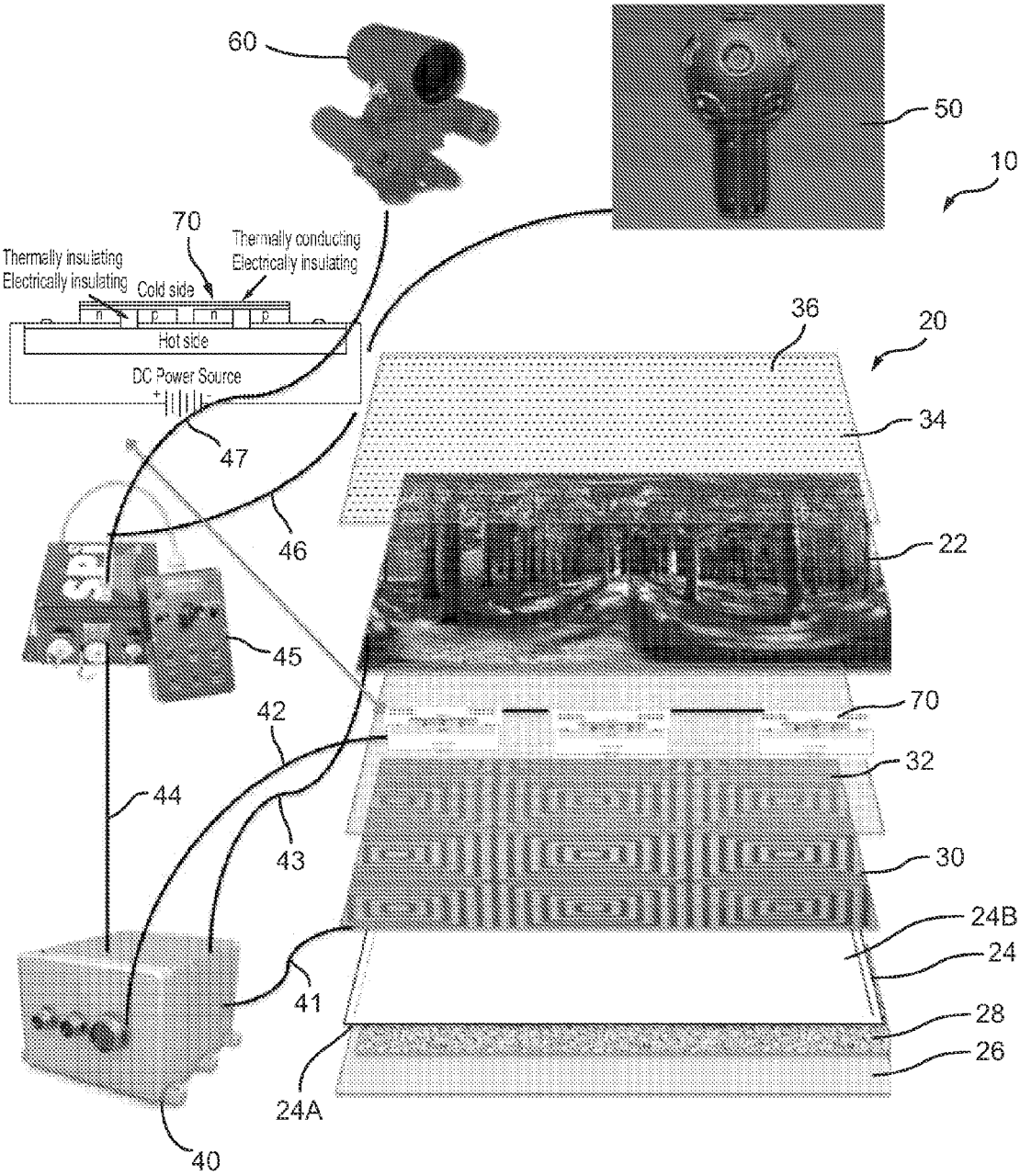
FIG. 11 illustrate a schematic view of an embodiment of a system for simultaneous adaptive camouflage, concealment and deception according to the present subject matter.

FIG. 11 illustrates a system 10 that can provide multispectral adaptive camouflage, concealment and deception to a physical item to which it is attached. The system 10 can include a controller 40 for controlling the system 10. The controller 40 can be a computer such as a microcomputer, a personal computer, a programmable logic controller, or the like. The system 10 can also include at least one sensor 60 for collecting environmental data from the environment surrounding the system 10 when in use. The sensor 60 can be a thermal sensor, a radar sensor or the like. The sensor 60 can also be a fusion sensor that can captures multiple types of environmental data. Such fusion sensors can even collect images for use in the system. Multiple sensors collecting the same or different data can be used in the system 10. The at least one sensor 60 can be in operable communications with the controller 40 via an adaptor device 45 that can provide a user interface to control the sensor 60. For example, line 44 connects the computer to the adaptor device 45 and line 47 connects the adaptor device 45 with the at least one sensor 60.

The system 10 can also include at least one image capturing device 50 for collecting images of the environment surrounding the system 10 for use in the system. The image capturing device 50 can capture video or photographic images. For example, the image capturing device 50 can be a digital camera. One or more such digital cameras can be used. For example, a digital camera position on each side of the physical item on which the system 10 is employed can be used. Alternatively, a single digital camera can be used. For example, a 360 image generating camera that takes images from all sides of the camera can be used. As mentioned above, the image capturing device 50 and the sensor 60 can be combined into a fusion sensor that can be used in the system 10. The at least one image capturing device 50 can be in operable communications with the controller 40 via an adaptor device 45 that can provide a user interface to control the image capturing device 50. For example, line 44 connects the computer to the adaptor device 45 and line 46 connects the adaptor device 45 with the at least one image capturing device 50.

The images collected by the image capturing device 50 provide site-specific images that can be displayed on a flexible image display matrix. Further, the controller can be programmed to turn the site-specific image provided by the image capturing device 50 into site-specific camouflage patterns as disclosed in U.S. patent application Ser. No. 12/221,540, filed Aug. 4, 2008, the disclosure of which is incorporated herein by reference in its entirety.

The system 10 also includes a lamina structured assembly 20 that can be used in the system 10 as described above. The lamina structured assembly 20 can include a vinyl substrate layer 24 that acts as a carrier for the lamina structured assembly 20. The vinyl substrate layer 24 strengths and adds protection to the lamina structured assembly 20. The vinyl substrate 24 can have an adhesive layer 26 as described above attached to a bottom surface 24A. The adhesive layer 26 can be used to secure the lamina structured assembly 20 to the physical item to be covered.

A first nanomaterial 28 can be disposed on the vinyl substrate layer 24 to provide a thermal suppression layer. The first nanomaterial 28 can provide thermal suppression to the physical item to which the lamina structured assembly 20 is applied. For example, the nanomaterial 28 can comprise an aerogel as described in detail above. The nanomaterial 28 can be added to the vinyl substrate layer 24 by a sputtering to randomly yet precisely dispose the nanomaterial 28 on the substrate layer 24. Alternatively, the nanomaterial 28 can be added to and mixed in with the material out of which the vinyl substrate layer 24 is made before the formation of the vinyl substrate layer 24.

A frequency selective surface array 30 as described above can be secured to the vinyl substrate layer. For example, the frequency selective surface array 30 can be embedded in the vinyl substrate layer 24. Alternatively, the frequency selective surface array 30 can reside on a separate substrate that is secured to the vinyl substrate layer 24. The frequency selective surface array 30 can be configurable to permit transmission of signals within one or more selected frequency ranges and to block transmission of signals within one or more other selected frequency ranges. The controller 40 can be in electrical communication with the frequency selective surface array 30 to provide power to the frequency selective surface array 30 and control the frequency selective surface array 30. For example, the controller can be connected to the frequency selective surface array 30 by line 41. The controller 40 can activate the frequency selective surface array 30. As stated above, in some embodiments, the frequency selective surface arrays can be tuneable. Thereby, the ranges of frequencies that are permitted to pass and the ranges of frequencies blocked can be changed.

A miniaturized thermoelectric device array 32 as described above can be secured to the vinyl substrate layer 24 overtop of the frequency selective surface array 30. The miniaturized thermoelectric device array 32 can include a plurality of miniaturized thermoelectric devices 70 positioned on a substrate. A schematic of a miniaturized thermoelectric device 70 is shown in a magnified view in FIG. 11. The miniaturized thermoelectric device array 32 can be configured to provide an adaptive thermal signature to a side 32A of the miniaturized thermoelectric device array 32 that faces outward from the vinyl substrate layer 24. The adaptive thermal signature, i.e., the temperature, to be mimicked can be supplied to the controller 40 by a sensor. The controller 40 can be in electrical communication with the miniaturized thermoelectric device array 32 to provide power to the miniaturized thermoelectric device array 32 and control the miniaturized thermoelectric device array 32. For example, the controller 40 can be connected to the miniaturized thermoelectric device array 32 by line 42.

The controller 40 can direct the miniaturized thermoelectric device array 32 to mimic the desired temperature. The at least one sensor 60 can be a thermal sensor that provides thermal environmental data to the controller 40. Based on this data, the controller 40 can direct the miniaturized thermoelectric device array 32 to provide an adaptive thermal signature to a side of the miniaturized thermoelectric device array 32 that faces outward from the vinyl substrate layer 24.

Thermoelectric cooling in the miniaturized thermoelectric devices 70 occurs when a DC current is passed through the module. The thermal bump pulls heat from one side of the device and transfers it to the other as current is passed through the material. This is known as the Peltier effect. The direction of heating and cooling is determined by the direction of current flow and the sign of the majority electrical carrier in the thermoelectric material. When combined with a feedback mechanism, the temperature of a target surface can be controlled and maintained by systematically toggling the direction of the current flow. To power and characterize these miniaturized thermoelectric devices 70, we have developed a high-speed computer controlled multi-channel power supply with integrated real-time infrared imaging. This system allows creation of individual temperature control profiles, and exploits the rapid response time of the thin-film device.

A flexible image display matrix 22 can also secured on the vinyl substrate layer 24 overtop of the miniaturized thermoelectric device array 32. As stated above, the flexible image display matrix 22 is configured to display visual images. The flexible image display matrix 22 can comprise a plurality of flexible image displays, such as OLED displays, PLED displays, or PHOLED displays. In this manner, the flexible image display matrix 22 can provide visual camouflage.

For example, the controller 40 can direct the flexible image display matrix 22 to display an image taken by an imaging capturing device in the environment in which the physical item to which the lamina structured assembly 20 is applied operates. The controller 40 can be in electrical communication with the flexible image display matrix 22 to provide power to the flexible image display matrix 22 and control the flexible image display matrix 22. For example, the controller 40 can be connected to the flexible image display matrix 22 by line 43. For instance, the controller 40 can direct the flexible image display matrix 22 configured to display at least one site specific image selected from the site-specific images captured by the at least one image capturing device 50. Each display of the plurality of displays that comprises the flexible image display matrix 22 can display a portion of the site-specific image.

A laminate layer 34 secured over the front surface 24B of the vinyl substrate layer 24 coating the flexible image display matrix 22 to provide protection to the a flexible image display matrix 22 and strengthen the lamina structured assembly.

A second nanomaterial 36 can be disposed on the laminate layer 34 to provide a radar suppression layer. The second nanomaterial 36 can provide radar suppression to the physical item to which the lamina structured assembly 20 is applied. For example, the A second nanomaterial 36 can comprise microspheres as described in detail above. The second nanomaterial 36 can be added to the vinyl substrate layer 24 by a sputtering to randomly yet precisely dispose the second nanomaterial 36 on the substrate layer 24. Alternatively, the second nanomaterial 36 can be added to and mixed in with the material out of which the laminate layer 34 is made before the formation of the laminate layer 34.

Through the use of the system 10 illustrated in FIG. 11, temperature and visual camouflage as well as thermal suppression, radar suppression and signal suppression can be provided to a physical item on which the system 10 is employed. The controller 40 can control the visual camouflage through images captured by the at least one image capturing device 50 and the display matrix 22. The controller 40 can control the thermal camouflage through environment data collected by the at least one sensor 60 and the miniaturized thermoelectric device array 32. Further, the controller 40 can control the radio wave suppression through communication with the frequency selective surface array 30. Further, the system 10 can include a thermal suppression layer in the form of powdered aerogels that insulate the physical item to which the lamina structured assembly 20 is attached. The system 10 can also include a radar suppression layer in the form of microspheres incorporated in the laminate layer 34 to disrupt signal waves pinging the physical item to which the lamina structured assembly 20 is attached. In this manner, a system 10 that provides simultaneous adaptive camouflage, concealment and deception can be provided. It is noted that other lamina structured assemblies as described above can be used in the system 10 in the alternative.

Embodiments of the present disclosure shown in the drawings and described above are exemplary of numerous embodiments that can be made within the scope of the appending claims. It is contemplated that the configurations of the systems and lamina structured assemblies for simultaneous adaptive camouflage, concealment and deception can comprise numerous configurations other than those specifically disclosed. The scope of a patent issuing from this disclosure will be defined by these appending claims.

What is claimed is:

1. A lamina structured assembly for simultaneous adaptive camouflage, concealment and deception, the assembly comprising:

a vinyl substrate layer;

a miniaturized thermoelectric device array secured to the vinyl substrate layer, the miniaturized thermoelectric device array configured to provide an adaptive thermal signature to a side of the miniaturized thermoelectric device array that faces outward from the vinyl substrate layer;

a flexible image display matrix secured on the vinyl substrate layer, the flexible image display matrix configured to display visual images;

a laminate layer secured over the vinyl layer covering the flexible image display matrix and the miniaturized thermoelectric device array to provide protection thereto and strengthen the lamina structured assembly; and one or more nanomaterials disposed on at least one of the vinyl substrate layer or the laminate layer to provide at least one of thermal or radar suppression.

2. The assembly according to claim 1, wherein the miniaturized thermoelectric device array is secured on the vinyl substrate layer overtop of the flexible image display matrix.

3. The assembly according to claim 1, wherein the flexible image display matrix is secured on the vinyl substrate layer overtop of the miniaturized thermoelectric device array.

4. The assembly according to claim 3, wherein the laminate layer coats the flexible image display matrix.

5. The assembly according to claim 1, wherein the flexible image display matrix comprises a plurality of flexible image displays.

6. The assembly according to claim 5, wherein the plurality of flexible image displays comprises organic light emitting diode displays.

7. The assembly according to claim 5, wherein the plurality of flexible image displays comprises polymer light emitting diode displays.

8. The assembly according to claim 5, wherein the plurality of flexible image displays comprises phosphorescent light emitting diode displays.

9. The assembly according to claim 1, further comprising a frequency selective surface array secured to the vinyl substrate layer, the frequency selective surface array configurable to permit transmission of signals within one or more selected frequency ranges and to block transmission of signals within one or more other selected frequency ranges.

10. The assembly according to claim 9, wherein the miniaturized thermoelectric device array is secured to the vinyl substrate layer overtop of the frequency selective surface array.

11. The assembly according to claim 9, wherein the flexible image display matrix is secured to the vinyl substrate layer overtop of the frequency selective surface array.

12. The assembly according to claim 1, wherein the one or more nanomaterials is disposed on the vinyl layer.

13. The assembly according to claim 12, wherein the nanomaterial is mixed into a vinyl material used to create the vinyl layer before the vinyl layer is formed.

14. The assembly according to claim 1, wherein the one or more nanomaterials comprises a first nanomaterial and a second nanomaterial.

15. The assembly according to claim 14, wherein the first nanomaterial is disposed on the vinyl layer.

16. The assembly according to claim 15, wherein the second nanomaterial is disposed on laminate layer.

17. The assembly according to claim 14, wherein the first nanomaterial comprises an aerogel in powder form and the second nanomaterial comprises microspheres.

18. The assembly according to claim 1, further comprising an adhesive layer disposed on a surface of the vinyl substrate layer opposite the surface on which the flexible image display matrix and the miniaturized thermoelectric device array are disposed.

19. The assembly according to claim 18, further comprising a thin metallic plate disposed on a surface of the adhesive layer opposite the surface of the adhesive layer on which the vinyl substrate layer is disposed.

20. A system for simultaneous adaptive camouflage, concealment deception for a physical item, the system comprising:

a lamina structured assembly comprising:

a vinyl substrate layer;

a miniaturized thermoelectric device array secured to the vinyl substrate layer, the miniaturized thermoelectric device array configured to provide an adaptive thermal signature to a side of the miniaturized thermoelectric device array that faces outward from the vinyl substrate layer;

a flexible image display matrix secured on the vinyl substrate layer, the flexible image display matrix configured to display visual images;

a laminate layer secured over the vinyl layer covering the flexible image display matrix and the miniaturized thermoelectric device array to provide protection thereto and strengthen the lamina structured assembly; and one or more nanomaterials disposed on at least one of the vinyl substrate layer or the laminate layer to provide at least one of thermal or radar suppression;

at least one sensor configured to collect environmental information from an environment surrounding the lamina structured assembly;

at least one image capturing device configured to capture site-specific images from the environment surrounding the lamina structured assembly; and a controller in communication with the miniaturized thermoelectric device array and the flexible image display matrix from the lamina structured assembly and at least one sensor and at least one image capturing device, the controller collecting information and processing information from the at least sensor and at least one image capturing device and controlling the output of the miniaturized thermoelectric device array and the flexible image display matrix.

21. The system according to claim 20, wherein the miniaturized thermoelectric device array is secured on the vinyl substrate layer overtop of the flexible image display matrix.

22. The system according to claim 20, wherein the flexible image display matrix is secured on the vinyl substrate layer overtop of the miniaturized thermoelectric device array.

23. The system according to claim 22, wherein the laminate layer coats the flexible image display matrix.

24. The system according to claim 20, wherein the flexible image display matrix comprises a plurality of flexible image displays.

25. The system according to claim 24, wherein the plurality of flexible image displays comprises organic light emitting diode displays.

26. The system according to claim 24, wherein the plurality of flexible image displays comprises polymer light emitting diode displays.

27. The system according to claim 24, wherein the plurality of flexible image displays comprises phosphorescent light emitting diode displays.

28. The system according to claim 20, further comprising a frequency selective surface array secured to the vinyl substrate layer, the frequency selective surface array configurable to permit transmission of signals within one or more selected frequency ranges and to block transmission of signals within one or more other selected frequency ranges.

29. The system according to claim 28, wherein the miniaturized thermoelectric device array is secured to the vinyl substrate layer overtop of the frequency selective surface array.

30. The system according to claim 28, wherein the flexible image display matrix is secured to the vinyl substrate layer overtop of the frequency selective surface array.

31. The system according to claim 28, wherein the controller is in communication with the frequency selective surface array from the lamina structured assembly, the controller controlling the output of the frequency selective surface array.

32. The system according to claim 20, wherein the one or more nanomaterials is disposed on the vinyl layer.

33. The system according to claim 32, wherein the nanomaterial is mixed into a vinyl material used to create the vinyl layer before the vinyl layer is formed.

34. The system according to claim 20, wherein the one or more nanomaterials comprises a first nanomaterial and a second nanomaterial.

35. The assembly according to claim 34, wherein the first nanomaterial is disposed on the vinyl layer.

36. The system according to claim 35, wherein the second nanomaterial is disposed on laminate layer.

37. The system according to claim 34, wherein the first nanomaterial comprises an aerogel in powder form and the second nanomaterial comprises microspheres.

38. The system according to claim 20, further comprising an adhesive layer disposed on a surface of the vinyl substrate layer opposite the surface on which the flexible image display matrix and the miniaturized thermoelectric device array are disposed.

39. The system according to claim 38, further comprising a thin metallic plate disposed on a surface of the adhesive layer opposite the surface of the adhesive layer on which the vinyl substrate layer is disposed.

40. The system according to claim 20, wherein the at least one sensor comprises a thermal sensor and the controller directs the miniaturized thermoelectric device array to provide an adaptive thermal signature to a side of the miniaturized thermoelectric device array that faces outward from the vinyl substrate layer base on information collected by the thermal sensor.

41. The system according to claim 20, wherein the controller directs the flexible image display matrix configured to display at least one site-specific image selected from the site-specific images captured by the at least one image capturing device.

* * * * *